United States Patent [19]

Nakai et al.

[11] 4,058,955

[45] Nov. 22, 1977

[54] COIN STACK SUPPORTING DEVICE IN COIN WRAPPING MACHINE

[75] Inventors: Shiro Nakai; Minoru Nakamura, both of Himeji, Japan

[73] Assignee: Glory Kogyo Kabushiki Kaisha, Japan

[21] Appl. No.: 733,191

[22] Filed: Oct. 18, 1976

[30] Foreign Application Priority Data

Oct. 18, 1975 Japan ..... 50-125581

[51] Int. Cl.[2] ..... B65B 11/04

[52] U.S. Cl. ..... 53/212

[58] Field of Search ..... 53/212

[56] References Cited

U.S. PATENT DOCUMENTS

| | | | |
|---|---|---|---|
| 3,775,940 | 12/1973 | Hatanaka | 53/212 |
| 3,950,921 | 4/1976 | Itoda et al. | 53/212 X |

*Primary Examiner*—Travis S. McGehee

*Attorney, Agent, or Firm*—Wenderoth, Lind & Ponack

[57] ABSTRACT

A coin stack supporting device has a closing disk for closing the bottom of a cylindrical space into which coins are received and stacked, a coin stack supporting member including a coin stack supporting cylinder, and a coin stack supporting center rod for raising the coin stack for wrapping and fold crimping operations, and an operating mechanism including cams and other parts for variously positioning the upper end of the coin stack supporting member and to withdraw the closing disk and the coin stack supporting member from the cylindrical space to retracted positions.

1 Claim, 7 Drawing Figures

COIN STACK SUPPORTING DEVICE IN COIN WRAPPING MACHINE

BACKGROUND OF THE INVENTION

This invention relates generally to coin wrapping machines and more particularly to a coin stack supporting device in a coin wrapping machine for supporting coins, which drop into a space formed between wrapping rollers, in a laminar or stacked state.

In proir art coin wrapping machines, coins supplied are caused to travel horizontally in a row by a turntable and a propelling device disposed along a coin passage adjacent to the turntable and are introduced into a direction-changing guide to have the direction changed into a substantially vertical direction, after which a predetermined number of coins are stacked in a coin stacking cylinder. This coin stack within the coin stacking cylinder is guided, while being supported by a guide rod, to a cylindrical space between a plurality of wrapping rollers positioned under the coin stacking cylinder. On one hand, a sheet of wrapping paper for wrapping the coin stack is guided by a wrapping paper supplying device to a clearance between the wrapping rollers, whereby the wrapping paper is wound round the cylindrical surface of the coin stack by the rotating wrapping rollers, and, at the same time, a pair of crimping hooks are introduced toward upper and lower portions of the coin stack to fold and crimp inwardly projectng edges of the wrapping paper, thereby to tightly wrap the coin stack.

However, a coin wrapping machine provided with a bulky coin stacking cylinder between the direction-changing guide and the wrapping rollers is disadvantageous in that the coin stacking cylinder not only increases the size of the entire machine but also complicates the construction thereof.

SUMMARY OF THE INVENTION

It is therefore an object of this invention to provide a coin stack supporting device in a coin wrapping machine wherein coins are directly allowed to drop one by one and be stacked within a cylindrical space between a plurality of upright wrapping rollers, a paper guide being positioned between the wrapping rollers to introduce a sheet of wrapping paper toward the cylindrical surface of the coin stack, and when a predetermined number of coins have been stacked therein, the coin stack is wrapped with a piece of the wrapping paper, the projecting lateral edges of which are fold crimped by crimping hooks.

The foregoing object is attained by the provision of a closing disk for closing the bottom of a cylindrical space formed between the wrapping rollers and the paper guide, the closing disk being formed with an opening in the center thereof, a coin stack supporting member slidably received in the opening capable of raising the coin stack to allow crimping hooks to be inserted into a space formed between the lowermost end of the coins stack and the closing disk, and an operating mechanism making use of cams or the like for purposes of positioning the coin stack supporting membr in the same plane as that of the closing disk or projecting the coin stack supporting member to a level higher than that of the closing disk in accordance with steps of wrapping, folding and crimping by the wrapping devices such as the wapping rollers or crimping hooks and integrally rotating and withdrawing the closing disk and the coin stack supporting member from which the closed position at the bottom in the cylindrical space, the closing disk and the coin stack supporting member being connected to the operating mechanism.

The nature, principles, and utility of this invention will be more clearly apparent from the following detailed description when read in conjunction with the accompanying drawings, in which like parts are designated by like reference numerals.

DETAILED DESCRIPTION

One embodiment of the present invention will now be described with reference to the accompanying drawings.

Figure 1:
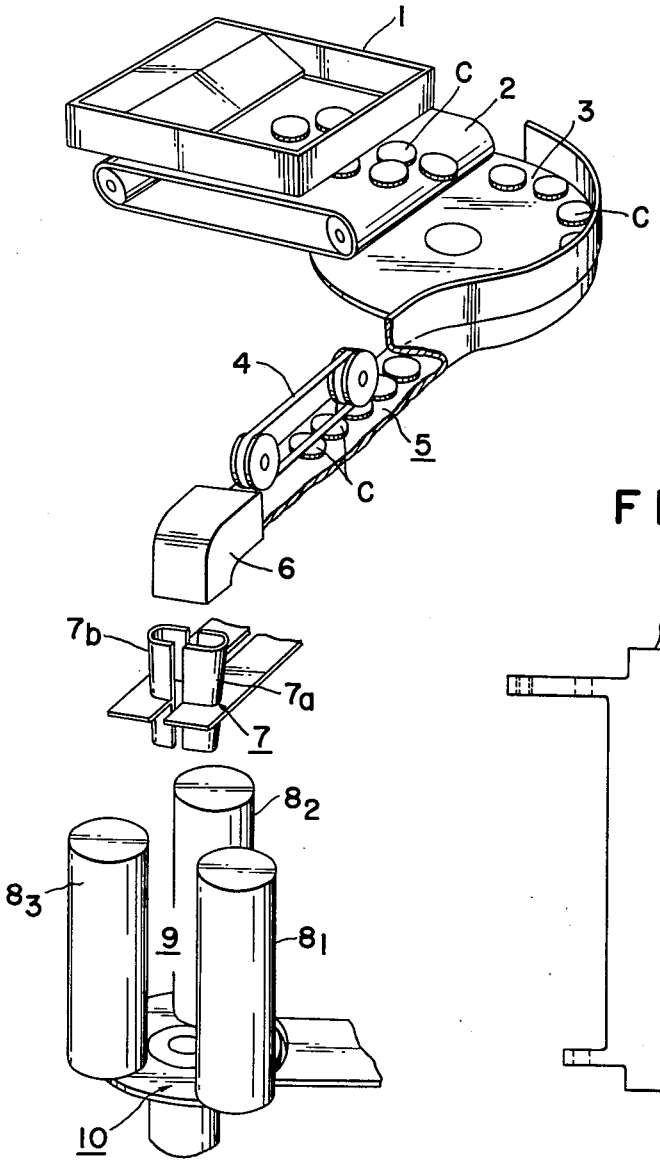
FIG. 1 is a perspective view of an essential portion in a coin wrapping machine; showing the flowpath of coins.

In FIG. 1, coins C supplied from a coin supplying hopper 1 are carried by a conveyor 2 to a turntable 3 and are arranged along the inner peripheral edge of the turntable 3 by the rotational centrifugal force thereof, after which the coins are guided by a propelling belt 4 into a direction-changing guide 6 after travelling horizontally along a coin passage 5. The coins thus directed in substantially the vertical direction by the direction-changing guide 6 pass through a coin guide 7 and then drop into a cylindrical space 9 between wrapping rollers 8 so that a predetermined number of coins are stacked on a coin stack supporting device 10 positioned immediately below the wrapping rollers 8.

The coin guide 7 comprises two trough-like guide members 7*a* and 7*b* opposed to each other, which form a flat passage through which one coin can pass in the longitudinal direction, each of the guide members 7*a* and 7*b* being connected to a spacing adjusting mechanism so that the spacing therebetween can be varied in accordance with the kinds of coins.

Figure 2:
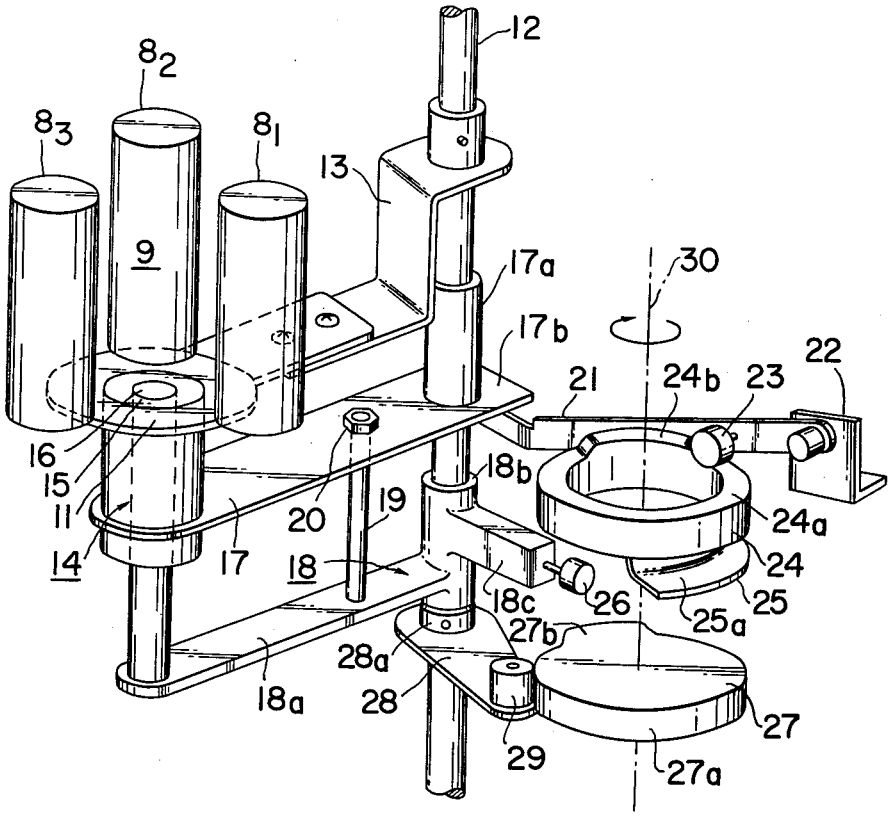
FIG. 2 is a perspective view of a coin stack supporting device in accordance with the present invention.

As shown in FIG. 2, the coin stack supporting device 10 has a closing disk 11 adapted to close the bottom of the space 9 between the wapping rollers 8 and positioned below the wrapping rollers, the closing disk 11 being mounted on the outer free end of a bent support plate 13 fixedly mounted on a vertical shaft 12. The closing disk 11 has a size such that it is capable of closing the bottom of the space 9 between the wrapping rollers 8 when the latter are fully opened, the disk has at its central portion a circular opening, in which a coin stack supporting member 14 is slidably engaged. This coin stack supporting member 14 comprises a thick-wall coin stack supporting cylinder 15 and a coin stack supporting center rod 16 which forms a center rod of the coin stack supporting cylinder 15 and has a diameter smaller than that of a coin to be processed, the coin stack supporting center rod 16 being slidably inserted in the center of the coin stack supporting cylinder 15.

The coin stack supporting cylinder 15 is held at its low end by the end of a support plate 17, which in turn has a base part 17*a* loosely mounted on the shaft 12 so that the support plate 17 can be slidably moved up and down along the shaft 12 and can be rotated about the shaft 12.

The coin stack supporting center rod 16 projects from the lower end of the coin stack supporting cylinder 15, and the projecting lower end thereof is fixedly mountedon the outer end of a long arm 18*a* of a support arm 18 having two arms and a base part 18*b* loosely mounted on the shaft 12. The support plate 17 and the long arm 18*a* of the support arm 18 are connected together by a connecting rod 19, which extends through the support plate 17. A nut 20 is screwed onto the upper end of the connecting rod 19, the lower end of which is secured to the long arm 18*a*. It is to be noted that the support plate 17 and the connecting rod 19 are movably connected so that the support plate 17 may be moved downward along the connecting rod 19.

On one hand, the support plate 17 is provided at the base part thereof with a lock projection 17*b*. One end of a follower lever 21 engages the lock projection 17*b*, while the other end thereof is pivotally mounted on a retaining member 22. The follower lever 21 is provided at an intermediate part thereof with a follower roller 23 (cam follower). This follower roller 23 engages a cam surface 24*a* of a first ring-like cam 24, which cam surface 24*a* is partly raised like a tableland to form a raised portion 24*b*.

At the lower part of the first cam is disposed a second cam 25, which is contoured to form a circular arc so that a roller 26 mounted on the outer end of a short arm 18*c* of the support arm 18 comes in contact with the cam surface 25*a* only for a given period of time corresponding to the wrapping and crimping processes carried out by the wrapping rollers and crimping hooks. At the lower part of the second cam 25 is disposed a generally disk-like third cam 27 having a cam surface 27*a* which is shaped to have a projection 27*b*. A roller 29 engages the cam surface 27*a*, the roller 29 being mounted on the outer end of a roller retaining arm 28 having a base part 28*a* which is secured to the shaft 12.

It is to be noted that the first cam 24, the second cam 25, and the third cam 27 are mounted on a cam line shaft 30 provided with cams and the like (not shown) for moving the wrapping roller and the crimping hooks. The raised portion 24*b* of the first cam, the cam surface 25*a* of the second cam, and the projection 27*b* of the third cam are positioned in a mutal relation such that the raised portion 24*b* causes the follower lever 21 to oscillate, the cam surface 25*a* engages the roller 26, and the projection 27*b* causes the roller retaining arm 28 to turn, according to the operational steps of the wrapping rollers and the crimping hooks, as will be described later.

Figure 3:
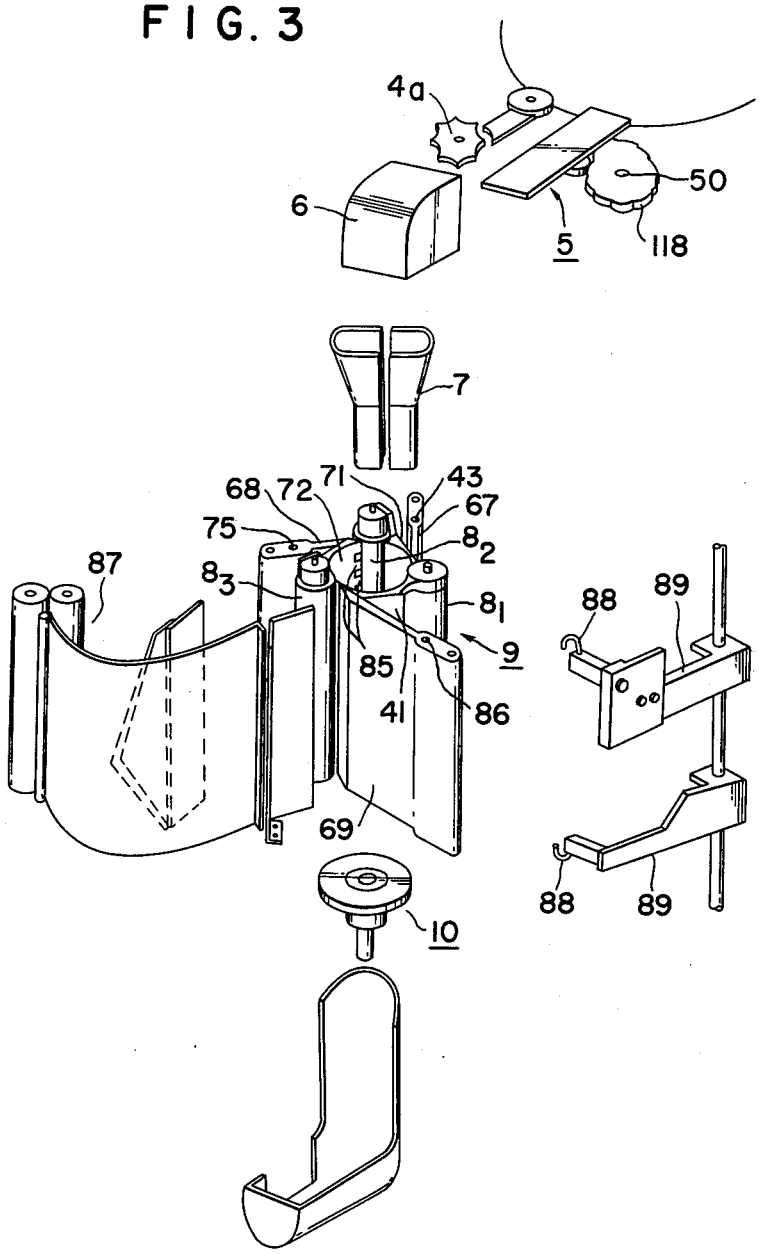
FIG. 3 is an exploded perspective view principally illustrating a coin wrapping device (9) to which the coin stack supporting device of the present invention can be applied.

Turning now to FIG. 3, which is a view showing a specific example in concrete form of a wrapping device 9 in accordance with the present invention, wherein smallest diameter coins are in a wrapping state, wrapping rollers $8_1$, $8_2$ and $8_3$ are supported by a link mechanism and are so designed that they may move toward and away from the center of the space therebetween.

Figure 4:
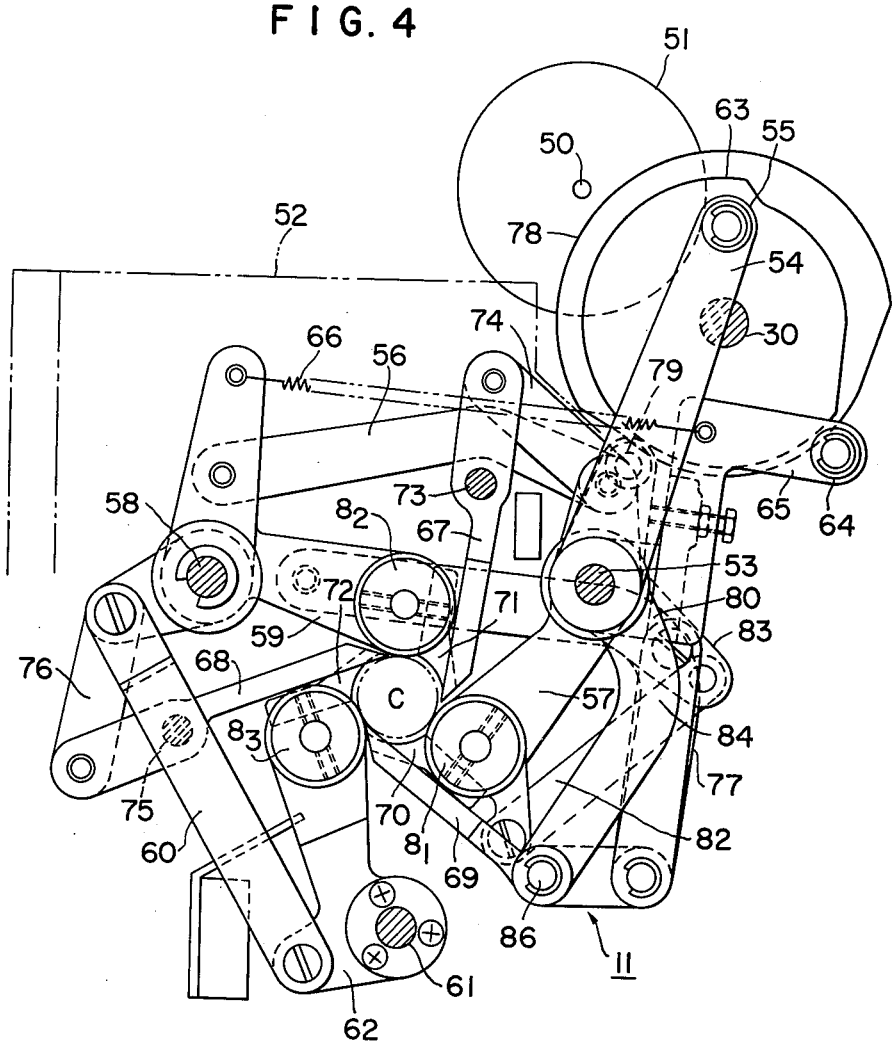
FIG. 4 is a plan view of the device in accordance with the present invention.

The abovementioned link mechanism has a construction wherein, as shown in FIG. 4, a cam 51 is mounted on a shaft 50 turned by a denomination setting knob (not shown) for coins C to be wrapped, and a roller 55 rotatably mounted on the outer end of an arm 54 rotatable about a shaft 53 supported on a base 52 is placed in contact with the cam 51.

Secured to the shaft 53 is an intermediate part of a first wrapping roller supporting arm 57, one end of which holds the upper and lower ends of the first wrapping roller $8_1$, the outer end being coupled to one end of a link member 56.

The outer end of the link member 56 is coupled to a second wrapping roller supporting arm 59 which supports upper and lower ends of the second wrapping roller $8_2$ and has a base part loosely fitted on a shaft 58.

A link member 60 is connected at its one end to one end of the second wrapping roller supporting arm 59 and is connected at its other end to a third wrapping roller supporting arm 62 which supports upper and lower ends of the third wrapping roller $8_3$ and is loosely fitted on a shaft 61.

An arm 65 having a roller 64 in contact with a cam 63 mounted on the aforementioned cam shaft 30 for determining operational timing of various parts of the coin wrapping machine including the abovementioned wrapping device is loosely fitted on the shaft 53, and a tension spring 66 is stretched between the arm 65 and the second wrapping roller supporting arm 59 to insure that the cam 63 is held in contact with the roller 64.

Main guide mebers 67, 68, and 69 and auxiliary guide members 70, 71 and 72 for guiding the coins C to be wrapped and a sheet of wrapping paper are disposed in a coin receiving space formed between the above-mentioned three wrapping rollers $8_1$, $8_2$, and $8_3$.

More specifically, the first main guide member 67 is loosely fitted on a shaft 73, and has one end thereof connected to the first wrapping roller supporting arm 58 by a link member 74. The second main guide member 68 is loosely fitted on a shaft 75 and is connected to the second wrapping roller supporting arm 59 by a link member 76.

The third main guide member 69 at one end thereof is connected to the second wrapping roller supporting arm 59 through a link member 77, and an arm 80 having a roller 79 in contact with a cam 78 mounted on the cam shaft 30 is loosely fitted on the shaft 53, one end of the arm 80 beng connected to the third main guide member 69.

The main guide members 67, 68, and 69 have respective tip portions sharply formed by beveling at their rear surfaces thereof. The tip portion of the main guide member 67 extends to the vicinity of a portion of the first wrapping roller $8_1$ facing the coin receiving space, and the tip portion of the second main guide member 68 and the tip portion of the third main guide member 69 extend to the vicinity of the second wrapping roller $8_2$ and the third wrapping roller $8_3$, respectively.

Figure 5:
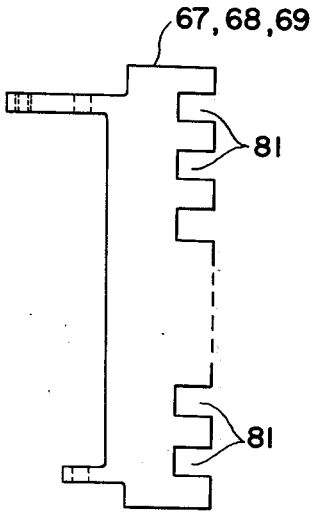
FIG. 5 is a planar view of a main guide member.

The tip portions of the main guide members 67, 68, and 69 respectively, have a plurality of notches 81 as shown in FIG. 5.

Among the auxiliary guide members 70, 71, and 72, on the other hand, the second and third auxiliary guide members 71 and 72 are secured to the second and third wrapping roller supporting arms 59 and 62, respectively, and the first auxiliary guide member 70 is loosely fitted on the shaft of the first wrapping roller $8_1$ and has one end connected to an arm 83 loosely mounted on the shaft 53 through a link member 82. This arm 83 is connected to a link member 84 which in turn is connected to one end of the main guide member 69.

The auxiliary guide members 70, 71, and 72 have tip portions having projections 85 (FIG. 3) received in the notches 81 formed in the tip portions of the main guide members 67, 68, and 69 as previously mentioned, and the inner surface directed toward the coin receiving space is contoured to have a concave arcuate surface so that when the notches 81 and the projections 85 come into engagement with one another, the abovementioned space is partly occupied by both guide members.

In operation, when the denomination setting knob (not shown) is rotated to select the denomination of coins to be wrapped, the cam 51 is rotated to rotate the arm 54 clockwise or counterclockwise as viewed in FIG. 4. This rotation of the arm 54 causes the shaft 53 to rotate, and the first wrapping roller supporting arm 57 then rotates clockwise thereby to move the first wrapping roller $8_1$ to a position corresponding to the denomination thus selected.

The rotation of the first wrapping roller supporting arm 57 causes the first main guide member 67 to be rotated clockwise on the shaft 73 through the link member 74 as viewed in the figure and further causes the second wrapping roller supporting arm 59 to be rotated clockwise through the link member 56, as a consequence of which the second wrapping roller $8_2$ is moved to the set position and the second auxiliary guide member 71 is also moved to the set position. The rotation of the second wrapping roller supporting arm 59 causes the second main guide member 68 to be rotated clockwise as viewed in the figure on the shaft 75 to assume the set position and further causes the third wrapping roller supporting arm 62 to be rotated clockwise through the link member 60, as a consequence of which the third wrapping roller $8_3$ is moved to the set position. Also, the rotation of the second wrapping roller supporting arm 59 causes the third main guide member 69 to be rotated clockwise as viewed in the figure on the pin 86 to assume the set position. This rotation of the third main guide member 69 causes the arm 83 to be rotated clockwise on the shaft 53 through the link member 84 and further causes the first auxiliary guide member 70 to be rotated clockwise on the shaft of the first wrapping roller $8_1$ through the link member 82 to assume the set position.

When the various elements are preset in the above described manner, they are now ready to receive coins of the denomination thus selected.

When a predetermined number of coins are counted by a counter mechanism (not shown) in the coin supplying device 4*a* and drop into the space surrounded by the wrapping rollers $8_1$, $8_2$ and $8_3$, the coins are caught on the coin stack supporting device 10 positioned at the bottom of the space. The cam shaft 30 is then rotated to rotate the cam 63, and the arm 65 in contact with the cam 63 rotates clockwise as viewed in the figure on the shaft 53. This rotation of the arm causes the second wrapping roller supporting arm 59 to be rotated counterclockwise through the tension spring 66, and the rotation of the second arm 59 causes the arm 83 to be rotated counterclockwise through the link member 84. This rotation of the link member 83 causes the auxiliary guide member 70 to be rotated counterclockwise through the link member 82.

In this manner, when the second wrapping roller supporting arm 59 is rotated counterclockwise, the second wrapping roller $8_2$, the first wrapping roller $8_1$ and the third wrapping roller $8_3$ come in contact with the peripheral surfaces of the coins C stacked on the supporting device 10, and at the same time, the first, second and third main guide members 67, 68, 69 and auxiliary guide members 70, 71, 72 are positioned close to the peripheral surfaces of the coins C. In this case, the main and auxiliary guide members have respective tip portions formed with notches 81 and projections 85, respectively, which are in engagement with one another, and, hence, the inner surfaces of the tip portions of the main guides from extended surfaces of the arcuate inner surfaces of the auxiliary guide members so that, even if the positions of the wrapping rollers to and from the guide members should be variously changed due to the diameters of the coins, the space defined by the wrapping rollers will always be formed into a cylindrical shape.

Thereafter, a piece of wrapping paper fed from a wrapping paper supplying device 87 enters a clearance between the cylindrical surface of the stack of the coins C and the wrapping rollers $8_1$, $8_2$, and $8_3$ from a position between the second wrapping roller $8_2$ and the main and auxiliary guide members 68 and 72 and is held therebetween and is wound around the coin stack along the inner surfaces of the main and auxiliary guide members.

After the wrapping paper has been wound around the cylindrical surface of the coin stack, the arm 80 is rotated clockwise as viewed in the figure about the shaft 30 by the cam 78 on the cam shaft 30, and this rotation of the arm 80 causes the third main guide member 69 to move in the direction such that the member 69 will withdraw from the clearance between the first wrapping roller $8_1$ and the second wrapping roller $8_2$. This withdrawing movement of the third main guide member 69 is effected through the arm 80 about the two coupling points with the shaft 30 and the link member 77. This movement of the third main guide member 69 causes the arm 83 to be rotated counterclockwise as viewed in the figure about the shaft 30 through the link member 84, and this rotation of the arm 83 in turn causes the first auxiliary guide member 70 to be rotated counterclockwise about the shaft of the first wrapping roller $8_1$ through the link member 82. Then, the auxiliary guide member 70 is withdrawn from the clearance between the first wrapping roller $8_1$ and the third wrapping roller $8_3$.

Thus, a space free from any member is formed between the first and third wrapping rollers $8_1$ and $8_3$, and arms 89 provided with crimping hooks 88, respectively enter the space to fold in and crimp the projecting lateral edges of wrapping paper thereby to produce a package of wrapped coins. After the coins have been thus wrapped, the supporting means 10 shown most clearly in FIG. 2 is withdrawn to discharge a wapped coin stack to an outlet.

Figure 6:
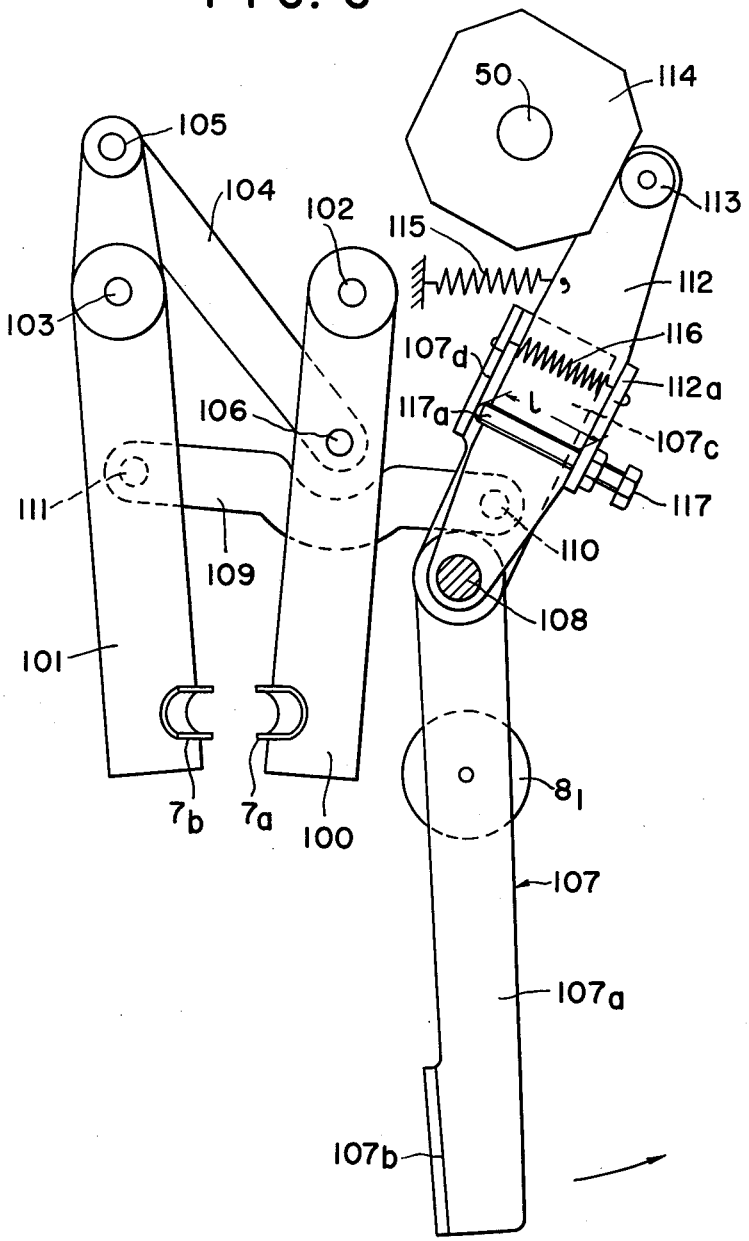
FIG. 6 is a plan view showing a spacing adjusting mechanism of the coin guide.
Figure 7:
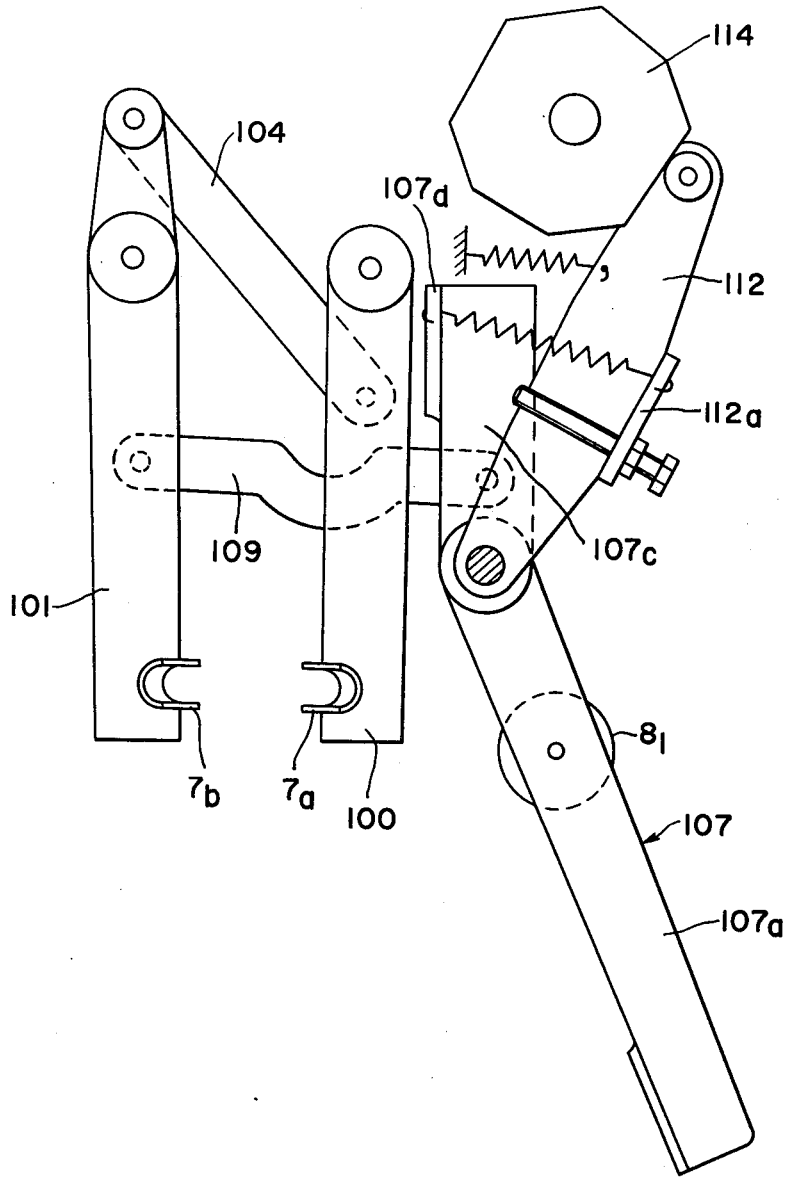
FIG. 7 is a plan view showing the state of the spacing adjusting mechanism as the coin guide opens.

The abovementioned coin guide 7 comprises two oppositely disposed trough-like guide members 7*a* and 7*b* each of U-shaped cross section having a depth decreasing progressively from the upper end toward the lower end thereof, as shown in FIGS. 6 and 7. These guide members 7*a* and 7*b* form a flat elliptical funnel-like coin falling passage through which one coin can drop longitudinally.

The guide members 7*a* and 7*b* are held on the ends of support plates 100 and 101, respectively, and the spacing between the guide members 7*a* and 7*b* is adjusted in accordance with the kind of coins to be processed by a mechanism as shown in FIG. 6. The support plate 100 has a rear end (an upper end in the figure) rotatably supported on a fixed shaft 102, and the support plate 101 has also a portion in the vicinity of the rear end pivotally supported on a fixed shaft 103. A connecting plate 104 at its one end is pivotally connected by a shaft 105 to the rear end of the support plate 101 and at its other end is pivotally connected to the support plate 100 by a shaft 106.

On one hand, the spacing adjusting mechanism for the coin guide is provided with a manually rotatable operating layer 107 bent at an intermediate point thereof, at which point it is rotatably mounted on a fixed shaft 108. The wrapping roller $8_1$ is coupled to an intermediate portion of a long arm 107*a* of the lever 107, the end (lower end in the figure) of which forms a grip portion 107*b*. A short arm 107*c* of the lever 107 has a riser flange 107*d* at the end thereof.

The short arm 107*c* and the support plate 101 are coupled together by a connecting bar 109, one end of which is pivotally connected to the middle portion of the short arm 107*c* by a shaft 110, while the other end is pivotally connected to the middle portion of the support plate 101 by a shaft 111.

One end of a follower lever 112 is rotatably mounted on the fixed shaft 108 in a manner such that the former is superposed on the short arm 107*c* of the operating lever 107, and the other end of the follower lever 112 is provided with a cam follower 113. This cam follower 113 is urged into contact with one side of an irregular octagonal cam 114 by a bias spring 115, and the cam 114 is cooperatively operated with a cam 118 of the same contour as that of the cam 114 adapted to select the width of the coin passage 5 in accordance with the kinds of coins. When the denomination selecting button is operated to select the denomination, a cam driving motor (not shown) is operated to rotate a cam shaft 50 through a corresponding angle. Alternatively, a denomination knob may be secured to the shaft 50, whereby the shaft can be manually rotated through a predetermined angle to select the denomination.

The follower lever 112 is formed with a riser flange 112*a* in the central portion thereof, the riser flange 112*a* being opposed to the riser flange 107*d* of the operating lever 107, and the two riser flanges are pulled toward each other by a tension spring 116.

The riser flange 112*a* is provided with an adjusting bolt 117 with its end 117*a* urged into abutting contact with the riser flange 107*d* of the operating lever 107 by the action of the spring 116. This adjusting bolt 117 is provided to finely adjust the spacing of the coin guide so that when the adjusting bolt 117 is rotated to adjust the distance between the riser 112*a* and the end 117*a* of the bolt, the short arm 107*a* of the operating lever 107 can be turned through an angle corresponding to the distance l to move the connecting bar 109 in the horizontal direction, thereby varying the spacing between the guide members 7*a* and 7*b*.

Next, the operation of the instant device will be described.

When the width of the coin passage (FIG. 1) is adjusted in accordance with a selected kind of coin by rotating the cam 118 (FIG. 3), the cam 114 (FIG. 6) rotates accordingly.

Since the cam 114 is an irregular octagon the sides of which are different in length, the lengths from the respective sides to the center of the cam are different. Accordingly, when the cam 114 is rotated to change the side thereof which comes in contact with the cam follower 113, the follower lever 112 rotates about the fixed shaft 108.

When the follower lever 112 is thus rotated clockwise in the figures with the cam follower 113 placed in contact with the shorter side of the cam 114, the short arm 107*c* of the operating lever 107 is biased toward the follower lever 112 by the spring 116 until the riser flange 107*d* of the short arm 107*c* comes into contact with the end 117*a* of the adjusting bolt 117. Conversely, when the cam 114 is operated to rotate the follower lever 112 counter-clockwise, the end 117*a* of the adjusting bolt 117 presses against the riser flange 107*d* of the operating lever 107 counterclockwise to rotate the operating lever counterclockwise.

When the short arm 107*c* of the operating lever 107 is rotated, the connecting bar 109 moves in substantially the horizontal direction to rotate the support plate 101 about the fixed shaft 103. When the support plate 101 is rotated, the connecting plate 104 affixed to the end thereof is moved to rotate the support plate 100 about the fixed shaft 102 in a rotating direction opposite to that of the support plate 101.

In the case where the spacing between the guide members 7*a* and 7*b* is not obtained as desired even when an attempt is made to adjust the spacing in the manner described above, the adjusting bolt 117 may be used for fine adjustment.

Further, in the case where the coins become jammed or clogged in the coin guide or the wrapping rollers, the grip portion 107*b* of the operating lever 107 can be rotated in the direction as indicated by the arrow to move the guide members 7*a* and 7*b* to an open state as shown in FIG. 7. That is, when the operating lever 107 is rotated in the direction of the arrow, the wrapping roller $8_1$ coupled to the long arm 107*a* of the operating lever 107 rotates in the opening direction, and, at the same time, the support plate 101 is rotated clockwise by the short arm 107*c* of the operating lever 107 through the connecting bar 109. As a consequence, the support plate 100 is rotated counterclockwise by the support plate 101 through the connecting plate 104, whereby the coin guide is also opened.

By the arrangement of the coin guide as previously described, the coins which have had their direction of movement changed by the direction-changing guide 6 drop into the coin guide with the spacing thereof adjusted in accordance with the kind of coin, and the coins within the coin guide are caused to fall in the desired direction, whereby the coins drop and are stacked in an orderly manner within the space surrounded by the wrapping rollers, and smooth post-processing, that is, a smooth coin wrapping operation using wrapping paper, is made possible.

Further, in the prior art wrapping machines, a coin stack cylinder is disposed between the direction-changing guide 6 and the wrapping rollers 8, while the coin guide of the invention is disposed in the same place as that occupied by the coin stack cylinder thereby eliminating the bulky coin stack cylinder, whereby the overall size of the machine is greatly reduced.

Turning again to FIG. 2, for a description of the operation, a predetermined number of counted coins are first have the falling direction thereof corrected as desired by the coin guide 7 and then drop into the cylindrical space 9 formed by the wrapping rollers 8 and the paper guide shown in FIGS. 3 and 4 disposed between the wrapping rollers. At this time, the closing disk 11 and the coin stack supporting member 14 are in one and the same plane to close the bottom of the space 9 as shown in FIG. 2, and the dropped coins are stacked on the coin stack supporting member 14. When a predetermined number of the coins are stacked thereon, the cam line shaft 30 begins its rotation in the direction as indicated by the arrow (clockwise), and, at the same time, the wrapping paper supplying device 87 shown in FIG. 3 is actuated so that a piece of wrapping paper is fed into the space formed between the wrapping rollers $8_1$, $8_2$ and $8_3$.

On one hand, when the coins are stacked on the coin stack supporting member, and the cam line shaft 30 begins its rotation, the follower roller 23 mounted on the follower lever 21 is moved onto the raised portion **24*b* of the first cam 24 thereby swinging the follower lever 21 clockwise, and, as a consequence, the support plate 17 is raised by the leading end of the follower lever 21**.

When the support plate 17 is raised, the support arm 18 is also raised therewith by the action of the connecting rod 19. Thus, the support plate 17, the coin stack supporting cylinder 15, and the coin stack supporting center rod 16 move up while supporting the coin stack, the distance of this upward movement corresponding to the height of paper edge fold crimping allowance required to fold crimp the wrapping paper edge to cover the lower end of the coin stack.

Then, the wrapping rollers $8_1$, $8_2$ and $8_3$ are rotated by a cam (not shown) mounted on the cam line shaft 30 and are moved toward the center of the space 9 by a link mechanism so that the wrapping rollers will come into contact with the peripheral cylindrical surface of the coin stack.

On one hand, the leading end of the wrapping paper is inserted into a clearance between the wrapping rollers and the coin stack as the wrapping rollers $8_1$, $8_2$ and $8_3$ rotate, and the leading end of the wrapping paper thus inserted is caught between the wrapping rollers and the cylindrical surface of the coin stack. In this case, the wrapping rollers 8 rotate at a speed greater than the feeding speed of the wrapping paper so that the wrapping paper is tensioned and cut into a desired length by a cutter disposed in the wrapping paper supplying passage.

Before the wrapping paper is cut into the desired length, the follower roller 23 in contact with the first cam 24 is moved downwardly from the raised portion **24*b* to turn the follower lever 21 counterclockwise, and hence, the support plate 17 is slidably moved downwardly, and the coin stack supporting cylinder 15 is also moved downwardly. As a consequence, the upper end of the cylinder 15 and the closing disk 11 are in one and the same plane. However, before the above mentioned follower roller 23 begins to roll down from the raised portion 24*b*, the cam surface 25*a* of the second cam is held in contact with the roller 26 mounted on the short arm 18*c* of the support arm, so that the coin stack supporting center rod 16 is held in a state wherein it continues to maintain the coin stack raised at a level higher than that of the closing disk 11 so as to form a clearance between the lower surface of the coin stack and the closing disk 11** through which a crimping hook is inserted.

When the wrapping paper thus cut is then wound round the peripheral surfaces of the coin stack by the wrapping rollers 8, upper and lower crimping hooks are respectively inserted toward the upper and lower end of the coin stack to fold crimp the outwardly projecting edges of the wrapping paper. During this crimping operation of the crimping hooks, the cam surface **25*a* of the second cam is disengaged from the roller 26, and the support arm 18 moves down until it is locked at the base part 28*a* of the roller retaining arm 28. As a consequence, the coin stack supporting center rod 16 moves down until the upper end surface thereof is in the same plane as the closing disk 11 and the coin stack supporting cylinder 15**. However, the coin stack will not drop since it is being rotated and held between the wrapping rollers.

After the crimping operation of the crimping hooks 88 has been completed, the crimping hooks are withdrawn from the space between the wrapping rollers by the action of a cam (not shown) mounted on the cam line shaft 30. Then, the projection **27*b* of the aforementioned third cam acts through the roller 29 and the roller retaining arm 28 to cause the shaft 12 to be rotated counterclockwise and to rotate the bent support plate 13 in the same direction, thus unitarily withdrawing the closing disk 11, the coin stack supporting cylinder 15, and the coin stack supporting center rod 16 from the lower position of the wrapping rollers. At this time, the wrapping rollers stop and are moved away from the wrapped coin holding position to the releasing position for discharge of the packet of wrapped coins. When this packet is discharged, the withdrawn closing disk 11, coin stack supporting cylinder 15, and related parts are again returned to their original positions by the action of the third cam 27** to complete preparation for the next succeeding cycle of supporting the coin stack.

By providing the closing disk 11, the coin stack supporting cylinder 15, and the coin stack supporting center rod 16 under the wrapping rollers 8 in this manner and moving the coin stack supporting cylinder 15 or the coin stack supporting center rod 16 up and down in accordance with the steps of the wrapping operation by the wrapping machine, the coins that drop into the space 9 formed between the wrapping rollers can be stacked and supported, and a disordered coin stack can be moved up by the height of a crimping allowance of the wrapping paper in a stable condition while increasing the coin supporting area by the coin stack supporting cylinder 15 when the coin stack is raised, thus making possible the crimping operation by the crimping hooks.

It will be appreciated that since the coins are stacked in an orderly manner by suitably adjusting the diameter of the cylndrical space formed by the wrapping rollers and the paper guide, the above described prior art coin stack supporting cylinder 15 and the cam mechanisms associated therewith, which function as an auxiliary support in raising the disordered coin stack in a stable condition, can be eliminated.

As is apparent from the foregoing, the device according to the present invention includes a closing disk 11 for closing the bottom of a cylindrical space formed by wrapping rollers and a paper guide, a coin stack supporting member 14 (including a coin stack supporting cylinder 15 and a coin stack supporting center rod 16) mounted in a central portion of the closing disk to raise a coin stack so as to enable fold crimping a sheet of wrapping paper by crimping hooks, and an operating mechanism making use of cams or the like capable of positioning the upper end of the coin stack supporting member 14 in the same plane as that of the closing disk 11 or projecting the upper end of the supporting member 14 to a level higher than that of the closing disk 11, in accordance with the steps of wrapping and fold crimping by the wrapping rollers or the crimping hooks and withdrawing the closing disk 11 and the coin stack supporting member 14 from the cylindrical space or returning the same to their original position.

By this arrangement, the present invention affords various advantageous features such as that the coins dropping directly into the space 9 formed between the wrapping rollers can be stacked, that wrapping by the wrapping rollers and fold crimping the opposite edges of the wrapping paper by the crimping hooks become possible, and that a bulky coin stacking cylinder can be eliminated by the provision of the coin stack supporting device as above described to reduce the overall size of the wrapping machine.

We claim:

1. In a coin wrapping machine the combination of a plurality of at least three vertically disposed wrapping rollers movable toward and away from each other to define a cylindrical stacking space having a diameter varying from the diameter of the smallest coins to be stacked and the largest coins to be stacked and into which coins are caused to drop one by one to be stacked in said cylindrical space and a sheet of wrapping paper is wrapped around the coin stack when a preselected number of coins have been stacked in said cylindrical space; a coin stack supporting device at the lower end of said cylindrical space having a closing disk with an outside periphery lying outside the periphery of the cylindrical space defined when said rollers are moved far enough apart to accommodate the largest size coins, said closing disk closing the bottom of said cylindrical space and having an opening in the central portion thereof, and a coin stack supporting member slidably received in said opening of said closing disk for raising the coin stack to a level higher than that of said closing disk so as to enable crimping hooks to be inserted into the space thus formed between the lowermost end of the coin stack and the closing disk thereby to crimp the upper and lower projecting edges of said wrapping sheet wrapped around the cylindrical surface of the coin stack; and an operating mechanism connected to said coin stack supporting member for positioning the upper surface of said coin stack supporting member in the same plane as that of said closing disk or raising the coin stack supporting member so that the upper surface of said supporting member is at a level higher than that of said closing disk during the wrapping by the wrapping rollers and fold-crimping by the crimping hooks, and for moving said closing disk and said coin stack supporting member from the position at the bottom of said cylindrical space where they close the bottom of said cylindrical space to respective withdrawn positions.

* * * * *